US007149444B2

(12) United States Patent
Tanaka et al.

(10) Patent No.: US 7,149,444 B2
(45) Date of Patent: Dec. 12, 2006

(54) IMAGE FORMING DEVICE, COLOR CALIBRATION METHOD AND ITS PROGRAM

(75) Inventors: Satoshi Tanaka, Ebina (JP); Matsuyuki Aoki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 259 days.

(21) Appl. No.: 10/857,959

(22) Filed: Jun. 2, 2004

(65) Prior Publication Data

US 2005/0117925 A1 Jun. 2, 2005

(30) Foreign Application Priority Data

Dec. 2, 2003 (JP) ..... 2003-402813

(51) Int. Cl.
*G03G 15/01* (2006.01)
*G03G 15/00* (2006.01)

(52) U.S. Cl. ..... 399/49; 399/39

(58) Field of Classification Search ..... 399/49, 399/39–41

See application file for complete search history.

(56) References Cited

U.S. PATENT DOCUMENTS 5,543,896 A * 8/1996 Mestha ..... 399/49
6,519,425 B1 * 2/2003 Fischer ..... 399/49
2002/0063907 A1 * 5/2002 Harrington
2002/0118976 A1 * 8/2002 Fischer ..... 399/49

FOREIGN PATENT DOCUMENTS

EP 1211885 A2 * 6/2002
JP A 10-224653 8/1998
JP B2 3150305 1/2001

* cited by examiner

*Primary Examiner*—Susan Lee
(74) *Attorney, Agent, or Firm*—Oliff & Berridge, PLC

(57) ABSTRACT

An image forming device includes an image forming section that forms an image onto a recording medium, a calibration section that performs a color calibration process based upon the image formed on the recording medium and a control section that, when a plurality of images are successively formed by the image forming section, reflects a result of the color calibration process by the calibration section on an image forming process at a timing when a continuity of the formed image or the recording medium is broken.

14 Claims, 11 Drawing Sheets

FIG. 4A

| | |
|---|---|
| JOB 1 (FIRST SET) | SHEET A (THICK PAPER) |
| | IMAGE DATA #01 (ONE) |
| JOB 2 (FIRST SET) | SHEET B (COATED PAPER) |
| | IMAGE DATA #02～#09 (ONE EACH) |
| JOB 3 (FIRST SET) | SHEET C (NORMAL PAPER) |
| | IMAGE DATA #10～#50 (ONE EACH) |
| JOB 4 (FIRST SET) | SHEET A (THICK PAPER) |
| | IMAGE DATA #51 (ONE) |
| JOB 5 (SECOND SET) | SHEET A (THICK PAPER) |
| | IMAGE DATA #01 (ONE) |
| JOB 6 (SECOND SET) | SHEET B (COATED PAPER) |
| | IMAGE DATA #02～#09 (ONE EACH) |
| JOB 7 (SECOND SET) | SHEET C (NORMAL PAPER) |
| | IMAGE DATA #10～#50 (ONE EACH) |
| JOB 8 (SECOND SET) | SHEET A (THICK PAPER) |
| | IMAGE DATA #51 (ONE) |

FIG. 4B

| | |
|---|---|
| JOB 3. 1 | SCREEN A |
| | IMAGE DATA #10～#20 (ONE EACH) |
| JOB 3. 2 | SCREEN A<br>SCREEN B |
| | IMAGE DATA #21～#23 (ONE EACH) |
| JOB 3. 3 | SCREEN A |
| | IMAGE DATA #24～#50 (ONE EACH) |

FIG. 5

| | |
|---|---|
| JOB 3.2 (FIRST SET) | SCREEN A<br>SCREEN B |
| | IMAGE DATA #21～#23 (ONE EACH) |
| JOB 3.3 (FIRST SET) | SCREEN A |
| | IMAGE DATA #24～#50 (ONE EACH) |
| JOB 4 (FIRST SET) | SHEET A (THICK PAPER) |
| | IMAGE DATA #51 (ONE) |
| CALIBRATION JOB | SHEET A, B, C<br>SCREEN A |
| | TEST IMAGE #0012 |
| JOB 5 (SECOND SET) | SHEET A (THICK PAPER) |
| | IMAGE DATA #01 (ONE) |
| JOB 6 (SECOND SET) | SHEET B (COATED PAPER) |
| | IMAGE DATA #02～#09 (ONE EACH) |

FIG. 6

| SHEET | SCREEN | TEST IMAGE | DIFFERENCE DATA | CALIBRATION VALUE |
|---|---|---|---|---|
| SHEET 1 | SCREEN 1 | NO. 0012 | AAA～BBB | +aaa |
| | | | BBB～CCC | +bbb |
| | | | ⋮ | ⋮ |
| SHEET 2 | SCREEN 1 | NO. 0014 | AAA～BBB | +fff |
| | | | BBB～CCC | +ggg |
| ⋮ | ⋮ | ⋮ | ⋮ | ⋮ |

S20

IMAGE FORMING DEVICE, COLOR CALIBRATION METHOD AND ITS PROGRAM

BACKGROUND OF THE INVENTION

1. Field of the Invention

The present invention relates to an image forming device performing color calibration.

2. Description of the Related Arts

It is known to provide an image forming method that in the case where a calibration is required to be executed during a successive formation of n images, the image forming process is stopped for executing the calibration, and the image forming process is restarted after this calibration process is finished. Further, it is known to provide a method that color patches are printed at a regular interval during the use of a printer, whereby the color patches are detected by a sensor and a color calibration value is decided based upon the detected color.

SUMMARY OF THE INVENTION

The present invention is accomplished in view of the abovementioned circumstance, and aims to provide an image forming device that can implement a satisfactory color calibration.

In order to attain the foregoing, an image forming device of the present invention includes an image forming section that forms an image onto a recording medium, a calibration section that performs a color calibration process based upon the image formed on the recording medium and control section that, when plural images are successively formed by the image forming section, reflects a result of the color calibration process by the calibration section on an image forming process at a timing when a continuity of the formed image or the recording medium is broken.

BRIEF DESCRIPTION OF THE DRAWINGS

Preferred embodiments of the present invention will be described in detail based upon the following figures, wherein:

FIGS. 4A and 4B are views illustrating job data generated at a job generating part 210, wherein 4A illustrates print command data inputted from a command obtaining part 200, while 4B illustrates jobs subdivided at the job generating part 210;

FIG. 5 is a view illustrating job data having calibration data inserted thereto;

FIG. 6 is a view illustrating a calibration table that is referred to in the case where a calibration value deciding part 364 decides a calibration value;

DESCRIPTION OF THE PREFERRED EMBODIMENTS

A first embodiment of the present invention will be explained hereinbelow.

At first, a printer device 10 to which the present invention is applied is explained.

Figure 1:
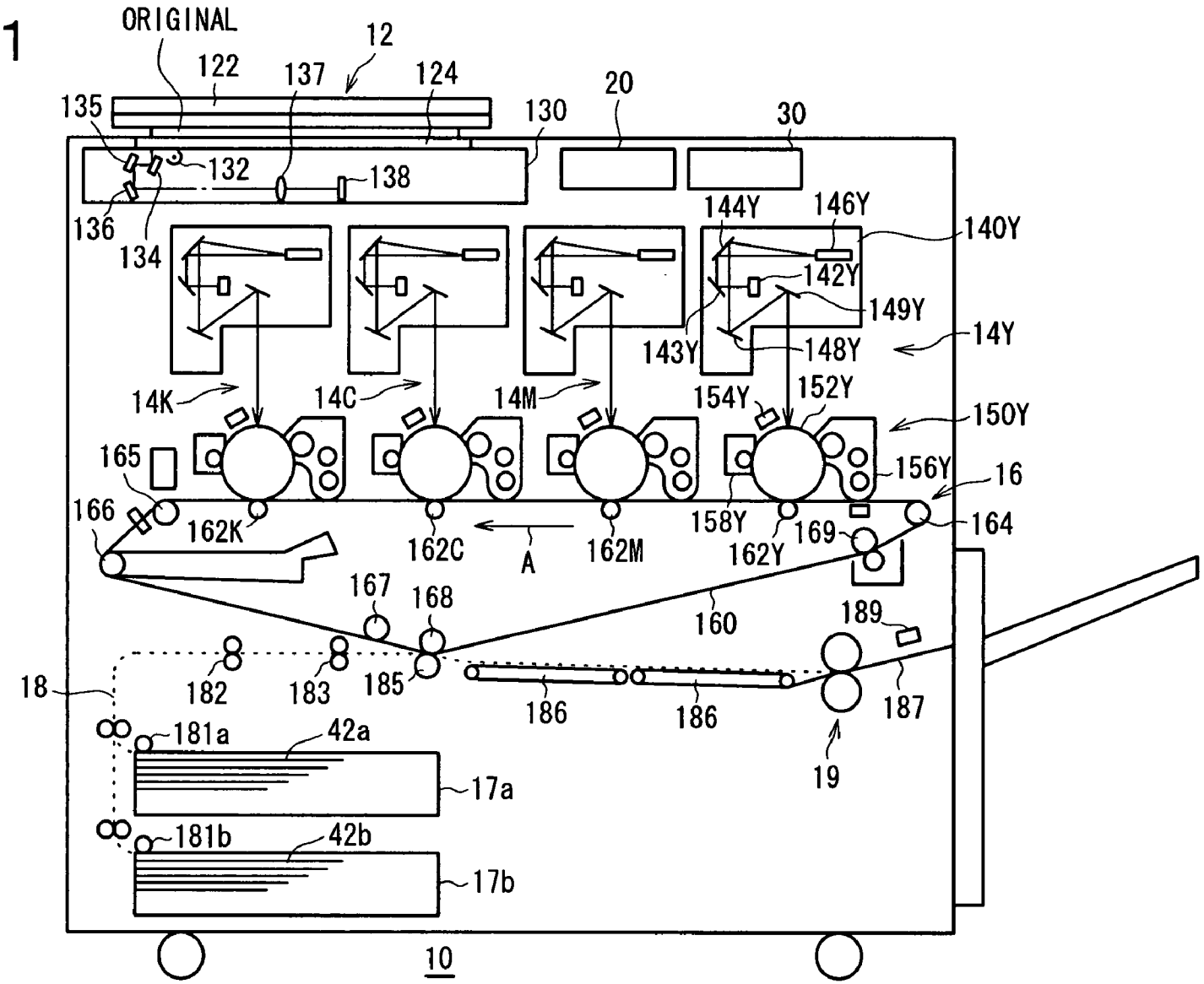
FIG. 1 is a view showing a configuration of a tandem-type printer device (image forming device) 10.

FIG. 1 is a view showing a construction of the tandem-type printer device (image forming device) 10.

As shown in FIG. 1, the printer device 10 has an image reading unit 12, an image forming unit 14, an intermediate transfer device 16, plural sheet trays 17, a sheet transport path 18, a fixing device 19, a controller 20 and an image processing device 30. This printer device 10 may be a complex machine having a function as a full-color copier using the image reading unit 12 and a function as a facsimile in addition to a printer function for printing image data received from a personal computer (not shown). Although the tandem-type printer device 10 provided with plural photoreceptor drums 152 is taken as a specific example in this embodiment, the invention is not limited thereto. For example, a printer device provided with only a single photoreceptor drum 152 may be used.

Firstly, an outline of the printer device 10 will be explained. Mounted at the upper portion of the printer device 10 are the image reading unit 12, controller 20 and the image processing device 30. The image reading unit 12 reads an image on a document and outputs the same to the controller 20. The controller 20 controls each construction of the printer device 10 such as the image forming unit 14, intermediate transfer device 16, image processing device 30 and the like. The image processing device 30 obtains image data inputted from the image reading unit 12 via the controller 20 or image data inputted from the personal computer (not shown) via a network such as a LAN, whereupon it performs an image processing such as a tone correction and resolution correction to this image data, and then, outputs the resultant to the image forming unit 14.

Mounted below the image reading unit 12 are plural image forming units 14 each corresponding to a color making up a color image. In this embodiment, a first image forming unit 14Y, second image forming unit 14M, third image forming unit 14C and fourth image forming unit 14K, each corresponding to each color of yellow (Y), magenta (M), cyan (C) and black (K), are horizontally arranged along the intermediate transfer device 16 with a constant space. The intermediate transfer device 16 rotates an intermediate transfer belt 160 as an intermediate transfer member in a direction shown by an arrow A in the figure. These four image forming units 14Y, 14M, 14C and 14K successively form a toner image of each color based upon the image data inputted from the image processing device 30, and the formed images are transferred (primary transfer) on the intermediate transfer belt 160 at a timing when these plural toner images are superimposed with one another. It should be noted that the order of the color of each of the image forming units 14Y, 14M, 14C and 14K is not limited to the order of yellow (Y), magenta (M), cyan (C) and black (K). The order of the color is optional, for example, it may be the order of black (K), yellow (Y), magenta (M) and cyan (C).

The sheet transport path 18 is disposed below the intermediate transfer device 16. A recording sheet 42*a* or 32*b* fed from a first sheet tray 17*a* or a second sheet tray 17*b* is transported on this sheet transport path 18, on which the toner image of each color that is transferred in a superimposed manner on the intermediate transfer belt 160 is transferred en bloc (secondary transfer). Then, the transferred toner image is fixed by the fixing device 37 and discharged to the outside.

Subsequently, each construction of the printer device 10 will be explained in more detail.

As shown in FIG. 1, the image reading unit 12 has a platen glass 124 on which the document is placed, a platen cover 122 that presses the document to the platen glass 124 and an image reading device 130 that reads the image of the document placed on the platen glass 124. The image reading device 130 is constructed so as to irradiate the document placed on the platen glass 124 with a light source 132, to scan a reflected optical image from the document via a reduction optical system formed of a full-rate mirror 134, a first half-rate mirror 135, a second half-rate mirror 136 and a focusing lens 137 to expose the reflected optical image onto an image reading element 138 formed of a CCD and the like, whereby a color reflected optical image from the document is read by the image reading element 138 at a predetermined dot density (e.g., 16 dots/mm).

The image processing device 30 performs a predetermined image processing to the image data read by the image reading unit 12, such as shading correction, correction of positional displacement of the document, brightness/color space conversion, gamma correction, deletion of frame, color/move editing and the like. It should be noted that the color reflected optical image of the document 30 read by the image reading unit 12 is document reflectivity data of three colors of red (R), green (G) and blue (B) (each 8 bits), and it is converted into document color tone data (raster data) of four colors of yellow (Y), magenta (M), cyan (C) and black (K) by the image processing of the image processing device 30.

The first image forming unit 14Y, second image forming unit 14M, third image forming unit 14C and fourth image forming unit 14K are horizontally juxtaposed at a constant space. They have almost the same construction except that the color of the formed image is different. Therefore, the following explanation is made about the first image forming unit 14Y. It should be noted that the construction of each of the image forming units is distinguished by marking Y, M, C or K.

The image forming unit 14Y has an optical scanning device 140Y that scans laser beam in accordance with the image data inputted from the image processing device 30 and an image forming device 150Y that forms an electrostatic latent image by the laser beam scanned by the optical scanning device 140Y.

The optical scanning device 140Y modulates semiconductor laser 142Y in accordance with the image data of yellow (Y) and emits laser beam LB (Y) from this semiconductor laser 142Y in accordance with the image data. The laser beam LB (Y) emitted from the semiconductor laser 142Y is applied to a rotational polygon mirror 146Y via the first reflection mirror 143Y and second reflection mirror 144Y, is deflected to be scanned by this rotational polygon mirror 146Y, and then, applied onto the photoreceptor drum 152Y of the image forming device 150Y via the second reflection mirror 144Y, third reflection mirror 148Y and fourth reflection mirror 149Y.

The image forming device 150Y is formed of the photoreceptor drum 152Y that rotates at a predetermined rotational speed along the direction of arrow A as an image bearing member, a scorotron 154Y for a primary charge that uniformly charges the surface of this photoreceptor drum 152Y as a charging section, a developer 156Y that develops the electrostatic latent image formed on the photoreceptor drum 154Y and a cleaning device 158Y. The photoreceptor drum 152Y is uniformly charged with the scorotron 154Y, whereby the electrostatic latent image is formed by the laser beam LB(Y) applied from the optical scanning device 140Y. The electrostatic latent image formed onto the photoreceptor drum 152Y is developed with yellow (Y) toner by the developer 156Y and transferred onto the intermediate transfer device 16. It should be noted that residual toner or sheet particles adhered to the photoreceptor drum 152Y after the transferring process of the toner image are removed by the cleaning device 158Y.

Like the abovementioned manner, the other image forming units 14M, 14C and 14K form a toner image of each color of magenta (M), cyan (C) and black (K) and transfers the formed toner image of each color onto the intermediate transfer device 16.

The intermediate transfer device 16 has an intermediate transfer belt 160 looped with a constant tension around a drive roller 164, a first idle roller 165, a steering roller 166, a second idle roller 167, a back-up roller 168 and a third idle roller 169. The drive roller 164 is rotatably driven by a driving motor (not shown), whereby the intermediate transfer belt 160 is circularly driven in the direction of arrow A at a predetermined speed. The intermediate transfer belt 160 is formed into an endless belt by, for example, forming a synthetic resin film such as polyimide having flexibility into a band, both ends of which are joined with adhesion.

Further, the intermediate transfer device 16 has a first primary transfer roller 162Y, a second primary transfer roller 162M, a third primary transfer roller 162C and a fourth primary transfer roller 162K at each position corresponding to each image forming unit 14Y, 14M, 14C and 14K, whereby it transfers the toner image of each color formed on each photoreceptor drum 152Y, 152M, 152C and 152K in a superimposed manner onto the intermediate transfer belt 160 by these primary transfer rollers 162. Residual toner adhered onto the intermediate transfer belt 160 is removed by a cleaning blade or a brush of a cleaning device for the belt disposed at the downstream side of the secondary transfer position.

Disposed at the sheet transport path 18 are a first sheet feed roller 181*a* and a second sheet feed roller 181*b* that pick up a first recording sheet 42*a* or a second recording sheet 42*b* from the first sheet tray 17*a* or second sheet tray 17*b*, a pair of sheet transport rollers 182 and a resist roller 183 that transports the recording sheets 42*a* and 42*b* to the secondary transfer position at a predetermined timing.

Further, a secondary transfer roller 185 that is in pressed contact with the back-up roller 168 is disposed at the secondary transfer position on the sheet transport path 18. The toner images of each color transferred onto the intermediate transfer belt 16 in a superimposed manner are secondary-transferred onto the recording sheet 42*a* or 42*b* with press-contact force and static electricity force by the secondary transfer roller 185. The recording sheet 42*a* or

42*b* having the toner images of each color transferred thereon is transported to the fixing device 19 by tow transport belts 186.

The fixing device 19 applies a heating process and pressurizing process to the recording sheet 42*a* or 42*b* having the toner images of each color transferred thereon, so that the toner is fused and fixed onto the recording sheet 42*a* or 42*b*.

The recording sheet 42*a* or 42*b* to which the fixing process (heating and pressurizing) is applied by the fixing device 19 passes through a discharge path 187 (transport path) disposed next to the fixing device 19 and is discharged to the outside of the printer device 10 and stacked onto a discharge tray. Further, a colorimetric sensor 189 is mounted to the discharge path 187. The colorimetric sensor 189 reads the image on the recording sheet 42*a* or 42*b* for measuring a characteristic amount of this image. The characteristic amount measured by the colorimetric sensor 189 includes, for example, color data (density of each color, saturation, hue, color distribution and the like).

Subsequently explained is a background of the present invention and an outline of this embodiment.

For example, there is a case where the printer device 10 receives from a user a print command that instructs to print plural images. In this case, the printer device 10 successively prints plural images in accordance with this print command. When the printer device 10 successively prints plural images in this way, the density or tone reproducibility of the printed image is changed due to an environmental change during the printing or the fluctuation of the device characteristic, resulting in differences in image quality among plural images printed in accordance with the same print command.

In view of this, it is desirable that the printer device 10 forms a test image during when images are successively printed and performs color calibration based upon this test image. The color calibration process means here a process for adjusting the printer device based upon the test image printed on the recording sheet. This color calibration process includes a reading process of the test image, a difference detecting process for detecting a difference between the basic device characteristic and the current device characteristic and a process for deciding an adjusting amount of the device characteristic based upon the result of the difference detecting process.

It is considered that the calibration process is performed during the successive printing based upon the toner image onto the photoreceptor drum 152 or the intermediate transfer belt 160. However, the toner image formed on the photoreceptor 152 is a single color, so that it is difficult to estimate the color development of the case where toners of plural colors are superimposed based upon this toner image. Further, when the toner image is fused and fixed onto the recording sheet 42, the color development occurs due to the mutual relation of the characteristic on the surface of the recording sheet 42, the order of the superimposition of the toner images of plural colors and properties of these toners, so that it is unsuitable to predict the color development after the fixing based upon the toner image formed on the intermediate transfer belt 160 and perform the color calibration. Therefore, the printer device 10 of this embodiment desirably performs the color calibration process based upon the toner image formed on the recording sheet 42. More preferably, the image forming device 10 performs the color calibration process based upon the toner image fixed onto the recording sheet 42.

Figure 2A:
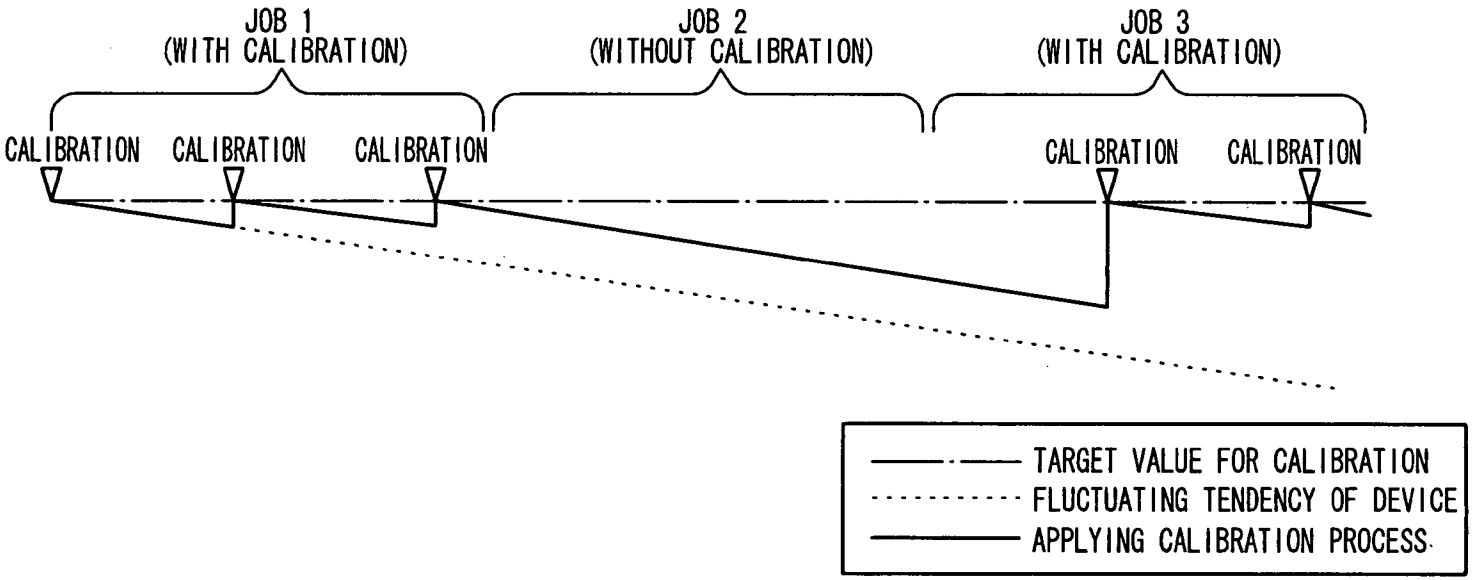
FIGS. 2A and 2B are views for explaining a timing of color calibration in the printer device 10, wherein 2A illustrates the case where the color calibration process is performed regardless of a changeover of a job, while 2B illustrates the case where the color calibration process is performed according to the changeover of the job.
Figure 2B:
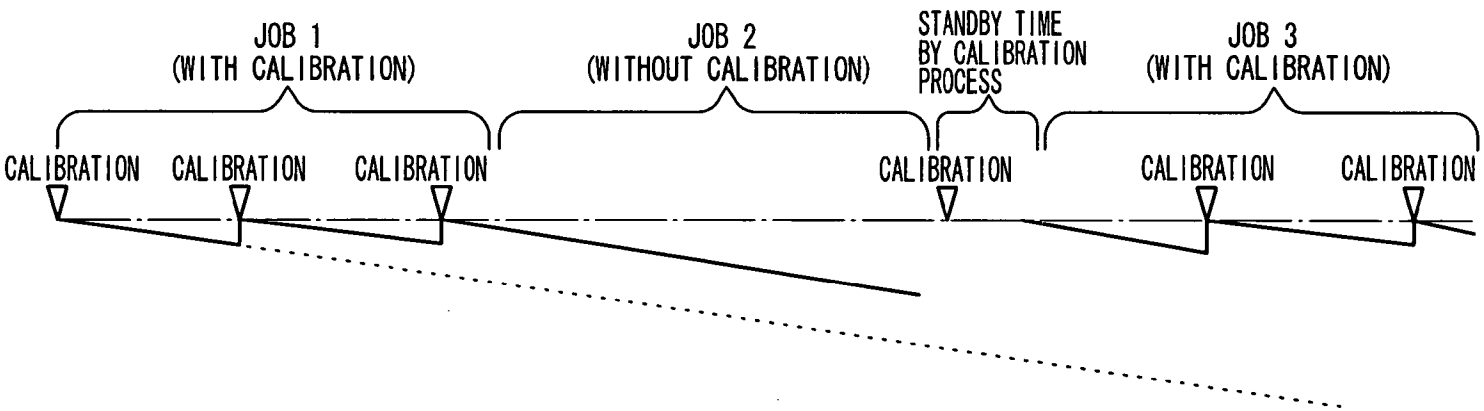

FIG. 2 is a view for explaining a timing of color calibration in the printer device 10. FIG. 2A illustrates the case where the color calibration process is performed regardless of the changeover of the job, while FIG. 2B illustrates the case where the color calibration process is performed in accordance with the changeover of the job. The job means here a process unit obtained by dividing the printing process demanded from the user, for example, it is a unit of a process that the image forming unit 14 or the intermediate transfer device 16 can print in the same operation mode. In this embodiment, the explanation is made by taking a specific example wherein a process unit (job) is separated when the type of the recording sheet 42 and screen or either one of them is changed, but the invention is not limited thereto. For example, the process unit may be separated with the changeover of the combination of toner (single-color toner, mixture of toners of tow colors, or mixture of toners of three colors) used for the printing process or with the changeover of the number of colors. Moreover, the operation mode is an operation type of each construction in the printer device 10 such as the image forming unit 14 or the intermediate transfer device 16, and it is set based upon the size or weight of the recording medium 32, type of image (color or monochrome), resolution of image or designation by the user (user selection mode) and the like. It should be noted that, in the "type of the recording sheet" in this embodiment, not only recording sheets each having a different material or different surface characteristic are distinguished as the different type, but also recording sheets each having the same material but having the different thickness, weight or size are distinguished as the different type.

As illustrated in FIGS. 2A and 2B, the printer device 10 obtains the print command data including plural jobs from a user interface device or a personal computer. These jobs are those wherein the printing process demanded by the user is divided by the personal computer (printer driver and the like) or the controller 20.

The printer device 10 successively processes these jobs and performs the color calibration process during when these jobs are processed. It should be noted that the printer device 10 does not perform the color calibration process for all jobs as illustrated in FIG. 2, but for example, it does not perform the color calibration process for the job of the monochrome printing (the "job 2" in the figure). In the case of the monochrome printing, only the black (K) toner is used, so that the color fluctuation is difficult to occur. In the case of the color printing, plural toners are superimposed to develop a specific color, so that a color fluctuation is likely to occur in accordance with the change in the ratio of toner of each color.

When the printer device 10 reflects the result of the color calibration process on the printing process regardless of the changeover of the job under such circumstance as illustrated in FIG. 2A, the color development characteristic is greatly adjusted during the "job 3", resulting in that a conspicuous color difference of the printed image.

In view of this, the printer device 10 in this embodiment reflects the result of the color calibration process at the timing when the continuity of the image to be printed or the continuity of the recording sheet used for the printing is broken (i.e., at the timing when the job is changed) as illustrated in FIG. 2B, thereby holding the color fluctuation to a minimum. "The timing when the continuity of the image to be printed is broken" includes, for example, a timing when an attribute of the image to be printed (photographic image, character image or line image) is changed, a timing when a screen applied to the image data to be printed is changed, a timing when the number of set is changed in the case where plural images are printed and a timing of the changeover between a monochrome image and a color image. "The timing when the continuity of the recording sheet used for the printing is broken" includes a timing when the type of the recording sheet is changed or a timing when the sheet tray 17 is changed.

The color development characteristic greatly differs between the "job 2" and the "job 3" in this embodiment. However, there is no continuity in the image to be printed because the combination of toner, the recording sheet or screen used for each job is different from each other, so that the difference in the color development characteristic between the jobs is not so conspicuous.

Figure 3:
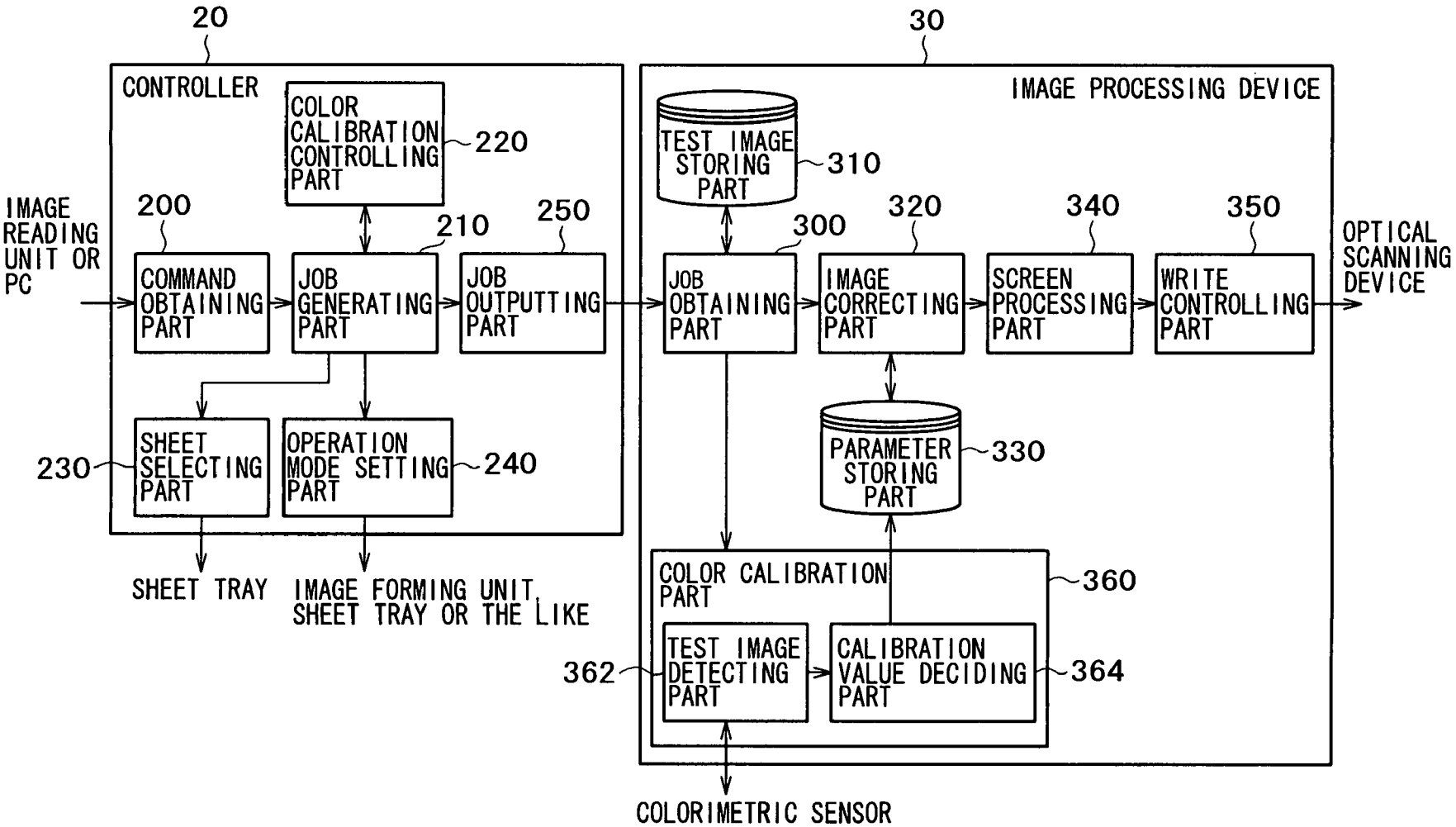
FIG. 3 is a view illustrating a functional construction of a first controller 20 and an image processing device 30.

FIG. 3 is a view illustrating the functional construction of the controller 20 and the image processing device 30.

As shown in FIG. 3, the controller 20 has a command obtaining part 200, color calibration controlling part 210, job generating part 220, sheet selecting part 230, operation mode setting part 240 and job outputting part 250. Further, the image processing device 30 has a job obtaining part 300, test image storing part 310, image correcting part 320, parameter storing part 330, screen processing part 340, write controlling part 350 and color calibration part 260, wherein the color calibration part 230 includes a test image detecting part 232 and calibration value deciding part 234.

It should be noted that each of the above-mentioned constructions included in the controller 20 and the image processing device 30 may be implemented by a software or hardware.

In the controller 20, the command obtaining part 200 obtains print command data including image data from the image reading unit 12 (FIG. 1) or a personal computer of the user and outputs the obtained print command data to the job generating part 220. The print command data includes, in addition to the image data required to be printed from the user, designating information for designating a type of the recording sheet used for the printing, the number to be printed and post-processing such as stapling.

The job generating part 210 interprets the print command data inputted from the command obtaining part 200, converts the interpreted data into a job that is a process unit which can be processed at the next image processing device 30 and outputs the converted data to the job outputting part 250. In the case where, for example, the print command data for requesting that plural images are printed is inputted, the job generating part 210 (process dividing section) divides the required printing process into plural process units in accordance with the continuity of the image to be printed and the continuity of the recording sheet that should be used for the printing, and then, outputs each of the divided process units to the job outputting part 250 as a job.

Moreover, the job generating part 210 outputs sheet discriminating information of the recording sheet used for the generated job to the sheet selecting part 230 and outputs information for specifying the operation mode, such as the type of the recording sheet, size and resolution of the image to be printed, to the operation mode setting part 240.

The color calibration controlling part 220 controls the timing when the result of the color calibration process is reflected on the printer device 10. In the case where plural jobs are continuously advanced, the color calibration controlling part 220 controls the job generating part 210 so as to make the color calibration process job (hereinafter referred to as a calibration job) interrupt according to the changeover of the job in this embodiment, whereby the result of the color calibration process is reflected on the printer device 10 at the timing when the continuity of the image to be printed or the continuity of the recording sheet is broken (i.e., at the changeover of the job). It should be noted that the color calibration controlling part 220 performs the color calibration process at the time of the changeover of the job by making the calibration job interrupt into the printing process job that is required from the user, and in addition to this, it may instruct the calibration value deciding part 364 to perform a predicted calibration process together with the job, that is now being executed, during the execution of the job. The predicted calibration process here means a relative calibration process wherein a color fluctuation value is predicted based upon a predetermined parameter (variable and the like generated during the nearest color calibration process) and the calibration value is decided based upon this predicted result. It differs from the color calibration process in that it does not read the test image.

The sheet selecting part 230 selects one recording sheet 42 among recording sheets of plural types (in this embodiment, the recording sheet 42*a* and recording sheet 42*b*) by controlling the sheet tray 17 and the sheet feed roller 181, and feeds the selected recording sheet 42 to the sheet transport path 18. For example, in the case where the image according to the request of the user is printed, the sheet selecting part 230 selects the recording sheet 42 according to the instruction from the user, while in the case where the test image for performing the color calibration is printed, it selects the recording sheet 42 (i.e., the recording sheet used in the following job) that is the subject of the color calibration.

The operation mode setting part 240 decides the operation mode based upon the mode specifying information inputted from the job generating part 210 and makes the image forming unit 14 (FIG. 1) and intermediate transfer device 16 operate in the decided operation mode. In this embodiment, the operation mode setting part 240 sets the operation mode for controlling the process speed of the image formation based upon the mode specifying information. For example, the operation mode setting part 240 controls the space between the toner images transferred onto the intermediate transfer belt 160 and the transport timing of the recording sheet 42 by the resist roller 183 according to the size of the image that should be outputted (for example, the size of the recording sheet 42). Moreover, the operation mode setting part 240 controls the writing speed by the optical scanning device 140 and each rotational speed of the photoreceptor drum 152 and intermediate transfer belt 160 according to the resolution of the image that should be outputted.

The job outputting part 250 outputs the jobs inputted from the job generating part 210 one by one to the image processing device 30. It should be noted that the job outputting part 250 may transmit the printing process job according to the request from the user and the calibration job to the image processing device 30 via the same communication interface, or independent communication interface may be provided for each of the printing process job and the calibration job, whereby these jobs may be transmitted to the image processing device 30 in parallel. In the type wherein the independent communication interface is provided for the calibration job, the job outputting part 250 can stop the job that is now being executed to make the calibration job interrupt with respect to the image processing device 30.

In the image processing device 30, the job obtaining part 300 obtains the job from the job outputting part 250 and performs a process according to the content of the obtained job. In the case where the obtained job is a part of the printing process required from the user, for example, the job obtaining part 300 outputs the image data that should be printed in this job to the image correcting part 320. Further, in the case where the obtained job is the calibration job, the job obtaining part 300 reads the data of the test image (color calibration image) from the test image storing part 310 and outputs the read data of the test image to the image correcting part 320. At this time, the job obtaining part 300 outputs the discriminating information read from the test image storing part 310 to the color calibration part 360.

The test image storing part 310 stores in advance the data of the test image used for the color calibration process. In this embodiment, the printer device 10 prints the test image prepared in advance for the color calibration, but the invention is not limited thereto. For example, a part or all of the image data (i.e., image data included in the print command data) requested to be printed from the user may be printed as a test image and used for the color calibration.

The image correcting part 320 performs a tone correcting process and sharpness correcting process to the image data inputted from the job obtaining part 300 and outputs the resultant to the screen processing part 340. In this case, the image correcting part 320 refers to a look-up table stored in the parameter storing part 330 to decide the correction amount of the tone correcting process and sharpness correcting process. The parameter storing part 330 memorizes a correction coefficient used for each correcting process such as the tone correcting process and the sharpness correcting process, whereby the image correcting part 320 corrects the inputted image data so as to be reproduced with a desired color and sharpness on the recording sheet 42 based upon the correction coefficient memorized in the parameter storing part 320.

The screen processing part 340 applies a screen process to the image data (multi-value) inputted from the image correcting part 320 to convert it into binary image data, and then, outputs the converted data to the write controlling part 350. The screen processing part 340 changes the screen according to the attribute of the image (photographic image, character image, line image). In the case where an image area of a photographic image and an image area of a character image are intermixed in an image of one page, for example, the screen processing part 340 changes the screen for every image area.

The write controlling part 350 controls the optical scanning device 140 (FIG. 1) in accordance with the image data (binary) inputted from the screen processing part 340. For example, the write controlling part 350 generates a pulse signal in accordance with the inputted image data and outputs this pulse signal to the optical scanning device 140, thereby turning on or off the optical scanning device 140.

The color calibration part 360 includes the test image detecting part 362 and the calibration value deciding part 364 for performing the color calibration process of the printer device 10. Specifically, the test image detecting part 362 controls the colorimetric sensor 189 (FIG. 1) to read the test image printed on the recording sheet 42, thereby measuring the characteristic amount of the test image. The test image detecting part 362 outputs the measured characteristic amount to the calibration value deciding part 364.

The calibration value deciding part 364 performs the color calibration process (hereinafter referred to as a measured calibration process) based upon the test image printed on the recording sheet 42 or the color calibration process (hereinafter referred to as a predicted calibration process) based upon the predetermined color calibration value. Specifically, as the measured calibration process, the calibration value deciding part 364 compares the characteristic amount inputted from the test image detecting part 362 with the reference value (for example, a predetermined fixed value) that is a target value of the color calibration process to decide the color calibration value, and then, renews the look-up table memorized in the parameter storing part 330 according to this color calibration value. In other words, the calibration value deciding part 364 decides the calibration value of the device based upon the characteristic amount inputted from the test image detecting part 362, and adjusts the color of the image outputted from the printer device 10 according to this calibration value. In particular, it is desirable that the test image detecting part 362 measures the characteristic amount of the color developed by plural toners and that the calibration value deciding part 364 decides the color calibration value based upon the characteristic amount by plural toners.

Further, as the predicted calibration process, the calibration value deciding part 364 calculates a predicted value of the color calibration value based upon the predetermined color calibration value and renews the look-up table memorized in the parameter storing part 330 in accordance with this predicted value. The predicted calibration process here includes the one wherein the color calibration value that is needed is predicted with the state of the preceding check point (for example, a starting point of the job or the time of the last-time color calibration process) used as a target and the one wherein a color fluctuation amount (or color calibration value) is predicted based upon the color fluctuation amount (or color calibration value) relating to the other recording sheet and screen.

Although the color calibration part 360 renews the look-up table memorized in the parameter storing part 330 to thereby adjust the printer device 10 in this embodiment, the invention is not limited thereto. For example, the color development of the image formed on the recording sheet 42 is adjusted by the adjustment of the secondary transfer process (press-contact force or static electricity force) by the secondary transfer roller 185 or the adjustment of the fixing process (heat temperature or pressurizing force) by the fixing device 19, whereby the color calibration of the printer device 10 may be implemented.

FIG. 4 is a view illustrating job data generated from the job generating part 210, wherein FIG. 4A illustrates the print command data inputted from the command obtaining part 200 and FIG. 4B illustrates jobs subdivided by the job generating part 210.

As shown in FIG. 4A, the command obtaining part 200 obtains the print command data including plural jobs from a personal computer of a user. The print command data in this embodiment includes jobs of plural types wherein recording sheets (normal paper, thick paper or coated paper) that should be used for the printing are different from one another. Further, this print command data includes plural sets (parts) formed of the same printing content such as "job 1" to "job 4" and "job 5" to "job 8". Each job is obtained by dividing a series of printing process by the type of the recording sheet that should be used for this printing process. Each job includes the image data that should be printed and designation information of the recording sheet that should be used.

Further, as shown in FIG. 4B, the job generating part 210 subdivides the "job 3" inputted from the command obtaining part 200 into "job 3.1", "job 3.2" and "job 3.3". This subdivision is performed by the following reason. Specifically, since the number that should be printed by the "job 3" exceeds the predetermined upper limit value, the job generating part 210 divides the job 3 such that the number to be printed by each job ("job 3.1" to "job 3.3") is held to be not more than the upper limit value.

Moreover, the job generating part 210 divides the jobs according to the combination of the screen used at the screen processing part 340. Although the screen processing part 340 in this embodiment selects a screen according to the image attribute of every image area, a screen applied by the screen processing part 340 may be selected by the image processing device 30 according to the designation by a user. Further, the printer device 10 may obtain image data, to which the screen process has been applied in advance, from a user.

FIG. 5 is a view illustrating job data to which a calibration job is inserted.

As shown in FIG. 5, the job generating part 210 inserts, in accordance with the control of the color calibration controlling part 220, the calibration job for performing the measured calibration process among plural jobs generated based upon the print command data. The calibration job is a job for printing the test image by use of the recording sheet and screen used for the subsequent job. The test image printed by the calibration job is used for the measured calibration process.

The calibration job in this embodiment is inserted at the time of the changeover of the set (between the "job 4" and "job 5"). This allows to prevent that the recording sheet having the test image printed thereon is mixed in the set and this can let the user know the separation point of the set. Moreover, no great color adjustment is carried out when one set is printed, so that the difference in color development in the set is inconspicuous.

FIG. 6 is a view illustrating a look-up table that is referred to in the case where the calibration value deciding part 364 decides the calibration value.

As illustrated in FIG. 6, the calibration value deciding part 364 has a calibration table that associates the type of the recording sheet 42, the type of the screen, test image and difference data with each calibration value. The difference data is data showing the difference between the characteristic amount when the test image printed on the recording sheet is read and the reference characteristic amount set as a target value for the color calibration.

Figure 7:
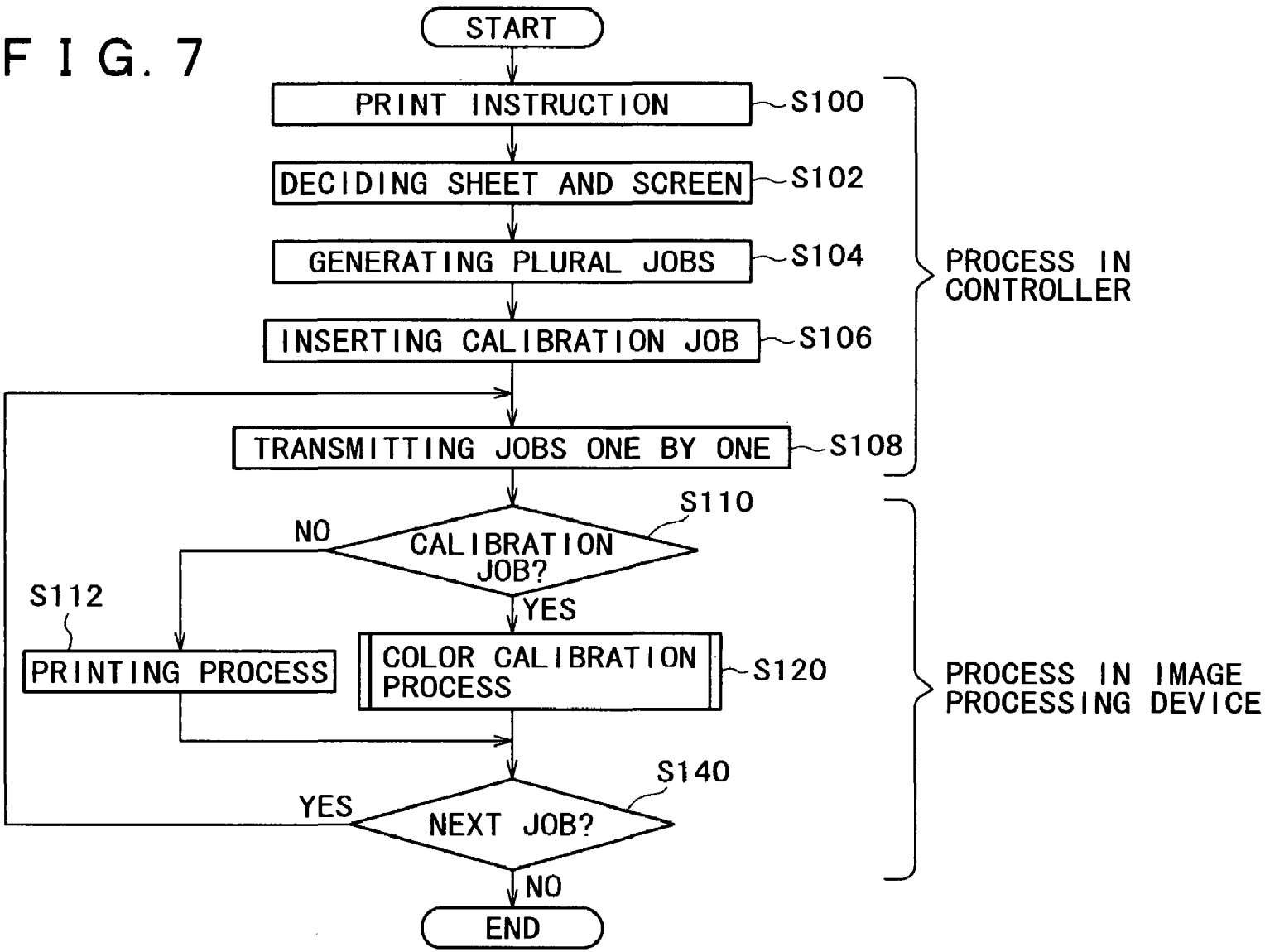
FIG. 7 is a flowchart of a printing process (S10) by the printer device 10.

FIG. 7 is a flowchart of a printing process (S10) by the printer device 10.

As shown in FIG. 7, a user gives a print command via a personal computer or a user interface of the printer device 10 at a step 100 (S100). When the print command including at least one job is inputted, the command obtaining part 200 obtains image data, that should be printed according to the print command from the user, via the network or the image reading unit 12, and outputs the same to the job generating part 210.

At a step 102 (S102), the job generating part 210 analyzes each job included in the print command data obtained by the command obtaining part 200 for deciding the type of the recording sheet and screen that should be used. Further, the job generating part 210 outputs the discriminating information of the decided recording sheet to the sheet selecting part 230. The sheet selecting part 230 controls the sheet tray 17 (FIG. 1) and feed roller 181 (FIG. 1) so as to feed the recording sheet to the secondary transfer position according to the discriminating information.

At a step 104 (S104), the job generating part 210 analyzes a number that should be printed in each job. In the case where the print number in each job exceeds the upper limit value, the job generating part 210 further divides the jobs according to the type of the recording sheet or screen, to thereby hold the print number in each job to be not more than the upper limit value.

At a step 106 (S106), the color calibration controlling part 220 instructs the job generating part 210 so as to interrupt the calibration job at the timing when the set, type of the recording sheet or screen is changed (i.e., at the timing when the continuity of the image to be printed or the continuity of the recording sheet used for the printing is broken).

The job generating part 210 searches from plural jobs the timing when the set, type of the recording sheet or screen is changed according to the instruction from the color calibration controlling part 220, inserts the calibration job between the jobs found by the search, and then, outputs to the job outputting part 250.

At a step 108 (S108), the job outputting part 250 outputs one by one the plural jobs inputted from the job generating part 210 to the image processing device 30.

The job obtaining part 300 obtains the job from the job outputting part 250 and analyzes the obtained job at a step 110 (S110).

In the case where the obtained job is the calibration job, the job obtaining part 300 moves to the process at S120, and in other cases, it moves to a process at S112.

At a step 112 (S112), the job obtaining part 300 outputs the image data included in the job data to the image correcting part 320. The image correcting part 320 refers to the look-up table memorized in the parameter storing part 330 for performing the image quality correction process such as a tone correction to the image data inputted from the job obtaining part 300, and then, it outputs the resultant to the screen processing part 340. The screen processing part 340 converts the image data (multi-value) inputted from the image correcting part 320 into binary image data by use of the screen decided by the job generating part 210, and then, outputs the converted data to the write controlling part 350. The write controlling part 350 turns on or off the optical scanning device 140 according to the image data inputted from the screen processing part 340 to thereby write a latent image onto the surface of the photoreceptor drum 152. The latent image written on the photoreceptor drum 152 is developed by toner of each color, transferred onto the intermediate transfer device 16 in a superimposed manner, transferred onto the recording sheet 42, and subject to the fixing process at the fixing device 19. The recording sheet 42 subject to the fixing process passes through the discharge path 187 to be discharged to the outside of the printer device 10.

At a step 120 (S120), the job obtaining part 300, image correcting part 320, screen processing part 340 and write controlling part 350 print the test image on the recording sheet 42, and the color calibration part 360 performs the color calibration process of the printer device 10 based upon the test image printed on the recording sheet 42.

At a step 140 (S140), the job obtaining part 300 decides whether there are subsequent jobs or not. If there are subsequent jobs, the program returns to the process at S108 for processing the next job. In other cases, the printing process (S10) is ended.

Figure 8:
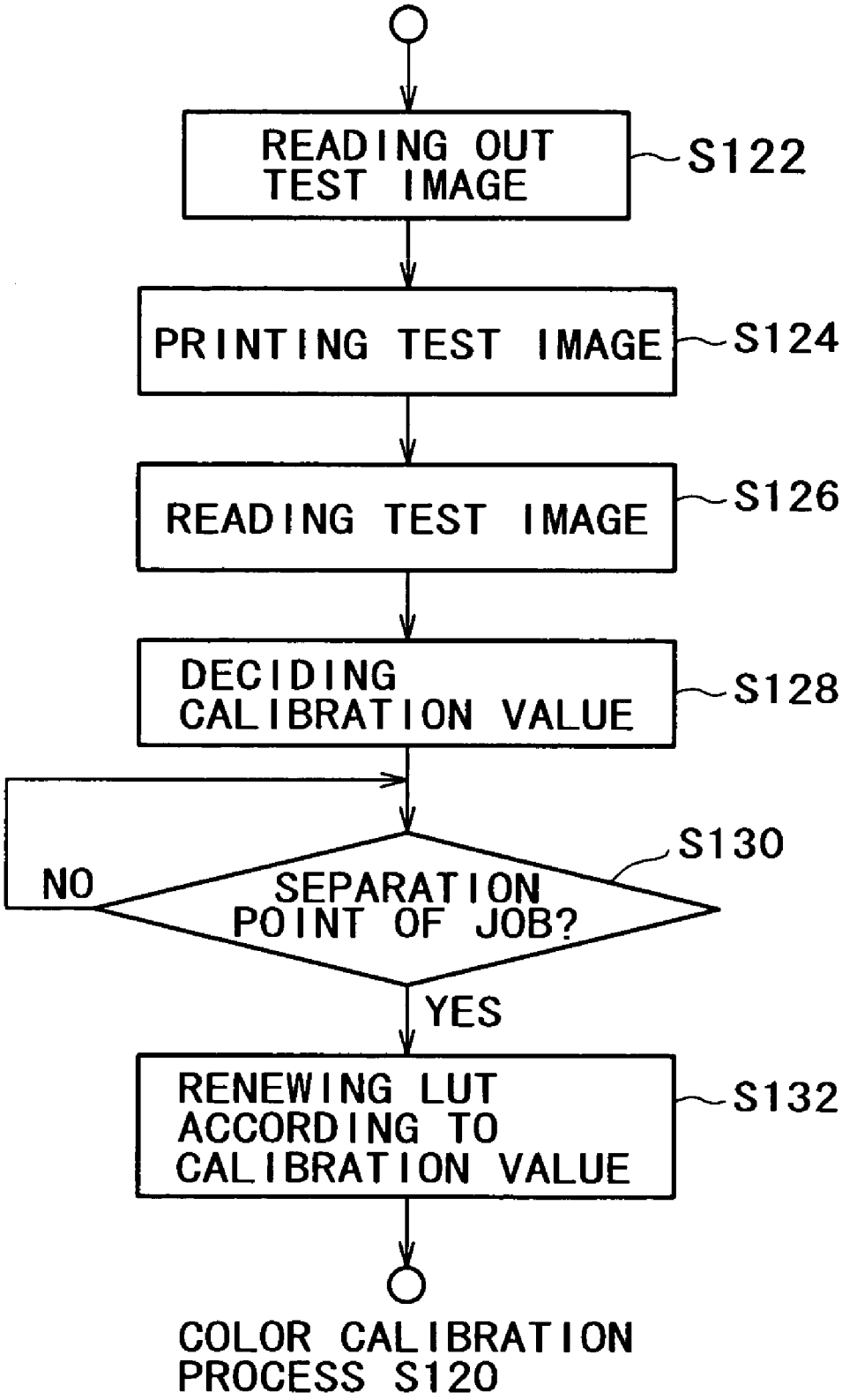
FIG. 8 is a flowchart of a color calibration process (S120) by the printer device 10.

FIG. 8 is a flow chart of the color calibration process (S120) of the printer device 10.

As shown in FIG. 8, the job obtaining part 300 reads the data of the test image from the test image storing part 310 according to the obtained calibration job and outputs the data of the read test image to the image correcting part 320 at a step 122 (S122). Further, the job obtaining part 300 outputs the discriminating information of the test image outputted to the image correcting part 320 to the color calibration part 360.

At a step 124 (S124), the image correcting part 320 refers to the look-up table memorized in the parameter storing part 330 for performing the image quality correction process such as a tone correction to the test image data inputted from the job obtaining part 300, and then, it outputs the resultant to the screen processing part 340. The screen processing part 340 converts the test image data (multi-value) inputted from the image correcting part 320 into binary image data by use of the screen designated by the calibration job (i.e., the screen used in the next job), and then, outputs the converted data to the write controlling part 350. The write controlling part 350 turns on or off the optical scanning device 140 according to the test image data inputted from the screen processing part 340 to thereby write a latent image of the test image onto the surface of the photoreceptor drum 152. The latent image of the test image written on the photoreceptor drum 152 is developed by toner of each color, transferred onto the intermediate transfer device 16 in a superimposed manner, transferred onto the recording sheet 42 designated by the calibration job (i.e., the recording sheet 42 used in the next job), and subject to the fixing process at the fixing device 19. The recording sheet 42 subject to the fixing process passes through the discharge path 187 to be discharged to the outside of the printer device 10.

At a step 126 (S126), the colorimetric sensor 189 disposed at the discharge path 187 optically reads the test image printed on the recording sheet 42 according to the control of the test image detecting part 362, and outputs the resultant to the test image detecting part 362. The test image detecting part 362 extracts the characteristic amount (color data) of the test image based upon the test image inputted from the colorimetric sensor 189 and outputs the extracted amount to the calibration value deciding part 364.

At a step 128 (S128), the calibration value deciding part 364 calculates the difference between the characteristic amount of the test image inputted from the test image detecting part 362 and the target value set in advance, and decides the calibration value according to this difference.

At a step 130 (S130), the calibration value deciding part 364 determines whether it is a separating point of the job or not. If it is the separating point of the job, the program moves to the process at S132. In other cases, the program stands by until the separating point of the job comes.

The calibration value deciding part 364 renews the look-up table memorized in the parameter storing part 330 according to the decided calibration value at a step 132 (S132).

As described above, the printer device 10 of the present embodiment reflects the calibration result on the parameter storing part 330 at the separating point of the job, thereby preventing the occurrence of color non-uniformness during the job.

Moreover, the printer device 10 prints the test image at the separating point of the set, thereby preventing the recording sheet having the test image printed thereon from being mixed in the set. The configuration of this embodiment is particularly effective in the printer device wherein the recording sheet printed according to the command from the user and the recording sheet having the test image printed thereon are discharged and stacked on the same discharge tray.

It should be noted that the calibration value deciding part 364 desirably reflects the calibration result immediately after the calibration job, but in the case where it takes time to calculate the calibration value, the calibration result may be reflected after jobs subsequent to the calibration job are completed.

Moreover, the printer device 10 desirably prints the test image with respect to all combinations of the recording sheet and screen used for the subsequent jobs to perform the calibration process, but the invention is not limited thereto. For example, the test image may be printed for only a fixed combination (reference combination), and for the job according to other combinations, the predicted calibration process may be applied. The reference combination means here a combination of the recording sheet and screen that are very frequently used for the printing process and it becomes a subject for the measured calibration process. The predicted calibration process is executed based upon the changing amount of the calibration amount decided with respect to the abovementioned reference combination.

A second embodiment will subsequently be explained.

In the first embodiment, the controller 20 divides jobs based upon the number that should continuously be printed, searches the timing when the continuity is broken among these jobs, and inserts the calibration job at this timing, thereby reducing an influence given to the continuous printing process by the color calibration process. In the second embodiment, the image processing device 30 monitors the factor of fluctuation of the color development characteristic (printing number, remaining toner amount, temperature change and the like). In the case where the factor of fluctuation exceeds an allowable range, it requests to the controller 20 the calibration job. The printer device 10 performs the measured calibration process only at a necessary timing according to this operation, whereby the influence given to the continuous printing process by the color calibration process can be held to a minimum.

Figure 9:
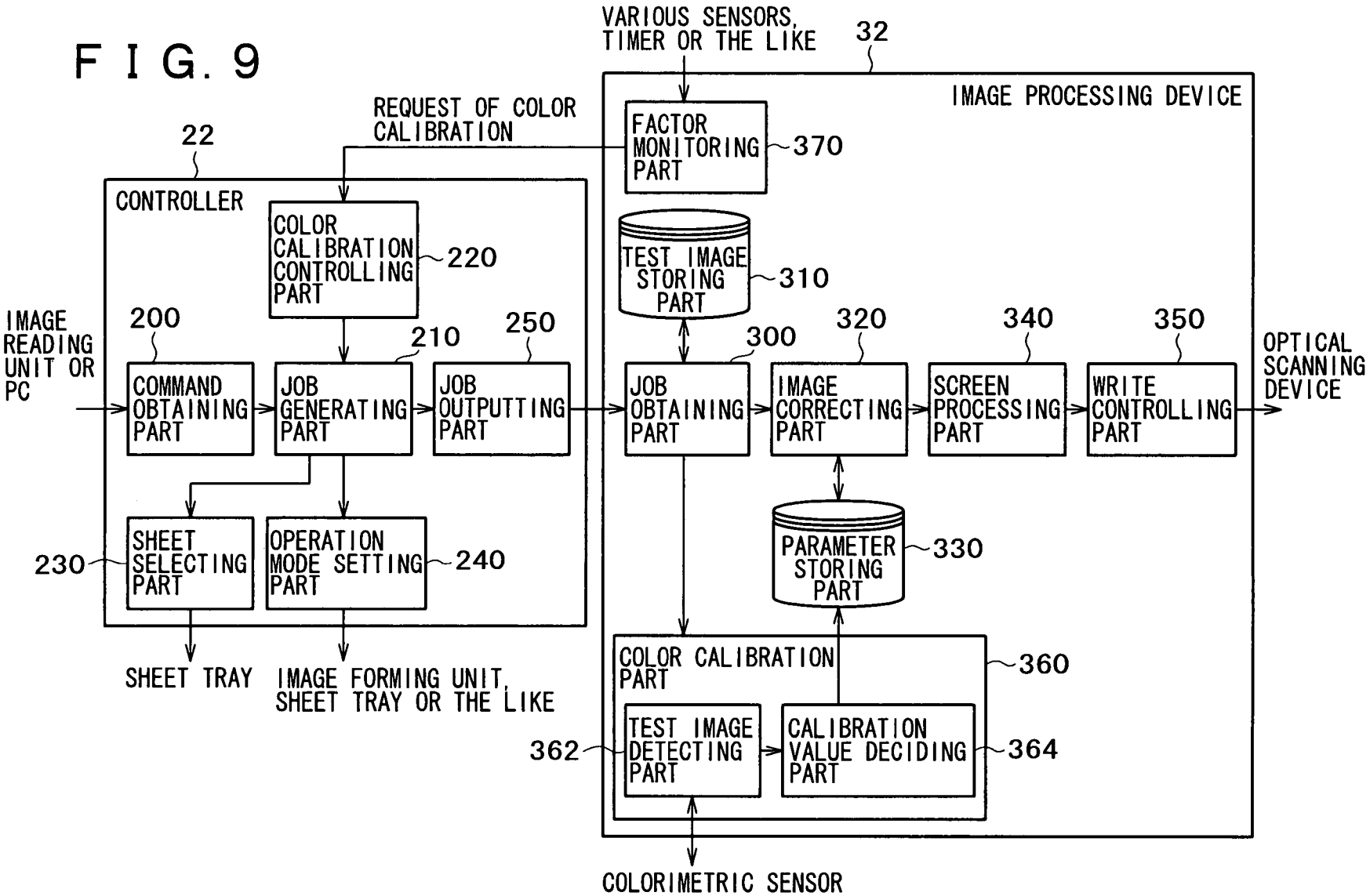
FIG. 9 is a view illustrating a functional construction of a second controller 22 and a second image processing device 32.

FIG. 9 is a view showing functional constructions of the controller 22 and the image processing device 32 in the second embodiment. It should be noted that, among each construction of the second controller 22 and the second image processing device 32 shown in FIG. 9, the same numerals are given to those substantially same as each construction of the first controller 20 and the first image processing device 30 shown in FIG. 3.

As shown in FIG. 9, the second image processing device 32 has a construction such that a factor monitoring part 370 is added to the first image processing device 30 shown in FIG. 3. Further, the second image processing device 32 has a communication interface that enables bidirectional communication for the controller 22.

The factor monitoring part 370 determines whether or not the output from a timer that counts a lapse of time (for example, lapse time from the last-time color calibration process), a counter that counts the print number, a residual amount sensor that detects residual amount of toner, an environment sensor that detects a changing amount of environment such as a temperature or humidity or a density sensor that detects a density of a toner image formed on the intermediate transfer belt 160 falls within a fixed range. In the case where any one of the outputs is outside of the fixed range (outside of the allowable range), the factor monitoring part 370 requests the calibration job to the color calibration controlling part 220 via the bidirectional communication interface. In other cases, it inhibits the insertion of the calibration job. It should be noted that the factors of fluctuation monitored by the factor monitoring part 370 may be a used state of a member forming the printer device 10, accumulated toner supply amount, accumulated pixel count or developability changing amount (change of density after development).

The measured calibration process may affect on productivity (printing speed) of the printer device 10, since it includes the printing process of the test image. Therefore, the image processing device 32 in this embodiment monitors the factor for which the color of the image printed on the recording sheet 42 is fluctuated, and only in the case where the factor of fluctuation of the color exceeds the allowable range, it requests the calibration job to the controller 22 to perform the color calibration process, thereby holding the influence on the productivity to a minimum.

Figure 10:
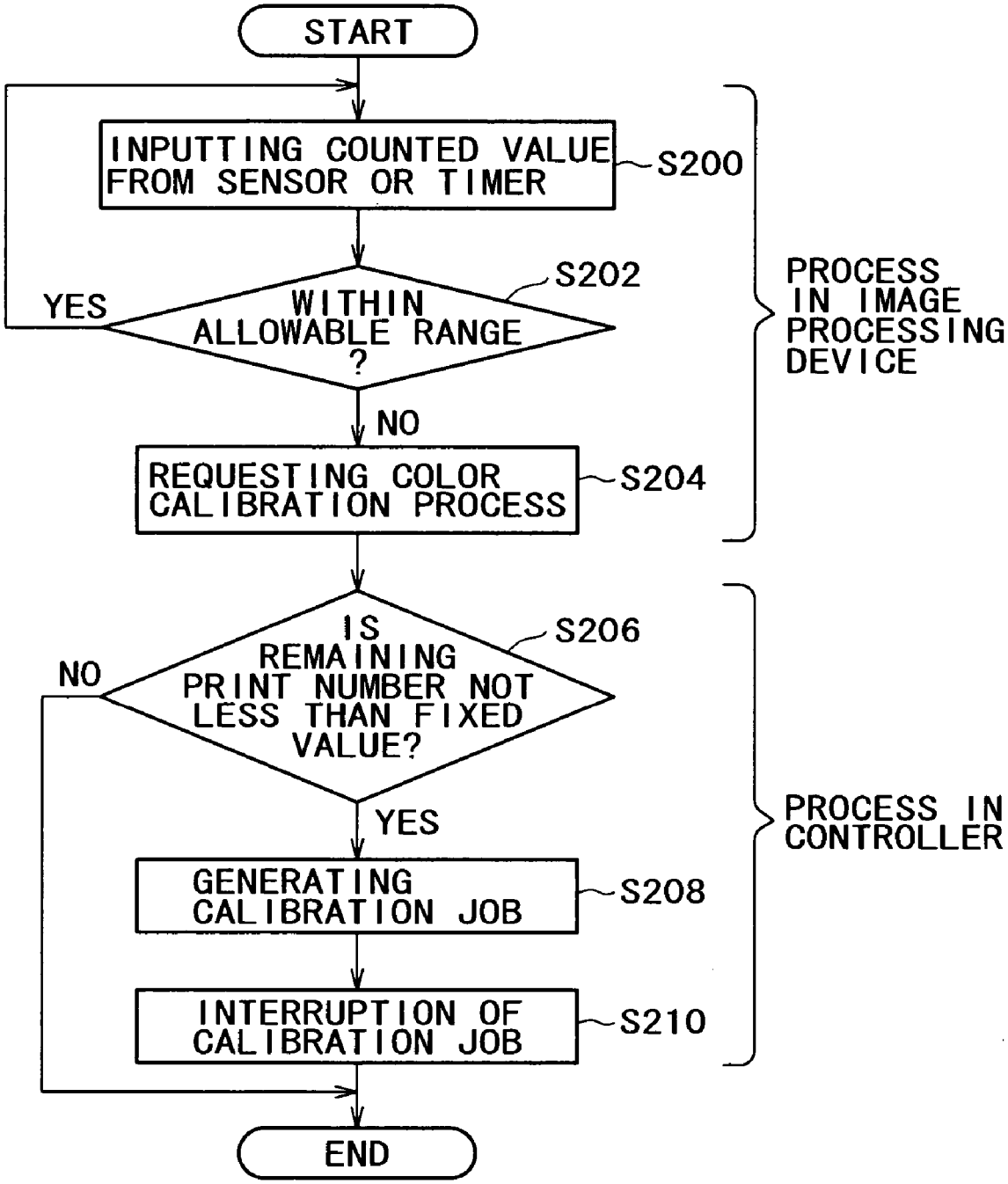
FIG. 10 is a flowchart of an interrupting process (S20) by the job generating part 210 and a color calibration control part 220 in the second controller 22 and a factor monitoring part 370 in the second image processing device 30.

FIG. 10 is a flowchart of the interruption process (S20) by the job generating part 210 and the color calibration controlling part 220 in the second controller 22 and the factor monitoring part 370 in the image processing device 30.

As shown in FIG. 10, the factor monitoring part 370 obtains the output values from the timer that counts a lapse of time, the counter that counts the print number, the residual amount sensor that detects residual amount of toner, the environment sensor that detects a changing amount of environment such as a temperature or humidity or the density sensor that detects a density of a toner image formed on the intermediate transfer belt 160 at a fixed timing at a step 200 (S200).

At a step 202 (S202), the factor monitoring part 370 determines whether or not the output values (i.e., color fluctuating factors) fall within the allow able range based upon the inputted output values. If they are the outside of the range, the program moves to the process at S204. In other cases, the factor monitoring part 370 inhibits the insertion of the calibration job from the color calibration controlling part 220, and then, returns to the process at S200 to keep on monitoring the color fluctuating factor.

At a step 204 (S204), the factor monitoring part 370 communicates with the color calibration controlling part 220 disposed at the controller 22 by use of the bidirectional communication interface for requesting the calibration job to the color calibration controlling part 220.

When receiving the request of the calibration job from the factor monitoring part 370, the color calibration controlling part 220 determines whether or not the number that should be printed at the subsequent job is not less than the fixed value at a step 206 (S206). If the number that should be printed at the subsequent job is not less than the fixed value, the program moves to a process at S208. In other cases, the process is ended without performing the generation of the calibration job. Specifically, when the remaining print number becomes less than the fixed value in the case where plural images are continuously printed, the color calibration controlling part 220 inhibits the color calibration process and causes to keep on the remaining print process. This is because, in the case where the print number is a few after the result of the color calibration process is applied, it is no use taking the trouble to perform the color calibration process.

At a step 208 (S208), the color calibration controlling part 220 controls the job generating part 210 so as to interrupt the calibration job. The job generating part 210 generates the calibration job for printing the test image with the recording sheet and screen used for the subsequent job according to the control of the color calibration controlling part 220.

At a step 210 (S210), the job generating part 210 makes the generated calibration job interrupt into the printing process requested from the user and outputs the resultant to the job outputting part 250. The job outputting part 250 transmits one by one plural jobs including the calibration job to the image processing device 32. When obtaining one by one the jobs from the job outputting part 250, the image processing device 32 processes one by one each job (including the calibration job) like the processes shown at S110 to S140 in FIG. 7.

As explained above, the printer device 10 in the second embodiment monitors the factor of the color fluctuation, and only in the case where the factor of the color fluctuation exceeds the allowable range, the color calibration process is performed, thereby being capable of restraining the reduction in productivity due to the color calibration process. Further, the printer device 10 in this embodiment decides whether the color calibration process is executed or not depending upon non-processed print number, thereby eliminating useless color calibration process.

A modified example of the abovementioned embodiment will be explained hereinbelow.

When the measured calibration process is only interrupted during the successive printing of an image, the productivity (i.e., printing speed) of the printer device 10 is lowered since the test image is printed on the recording sheet 42 as explained in the above-mentioned embodiment.

In view of this, a printer device in a first modified example performs at least one part of the measured calibration process, that is performed for the subsequent job, is performed simultaneous with the job now being executed, to thereby restrain the reduction in productivity due to the measured calibration process. It should be noted that "simultaneous performing" includes the case where the job now being executed is temporarily stopped and a part of the measured calibration process is interrupted and the case where a part of the measured calibration process is performed simultaneous with the job now being executed (parallel processing using independent resources).

Figures 11A, 11B:
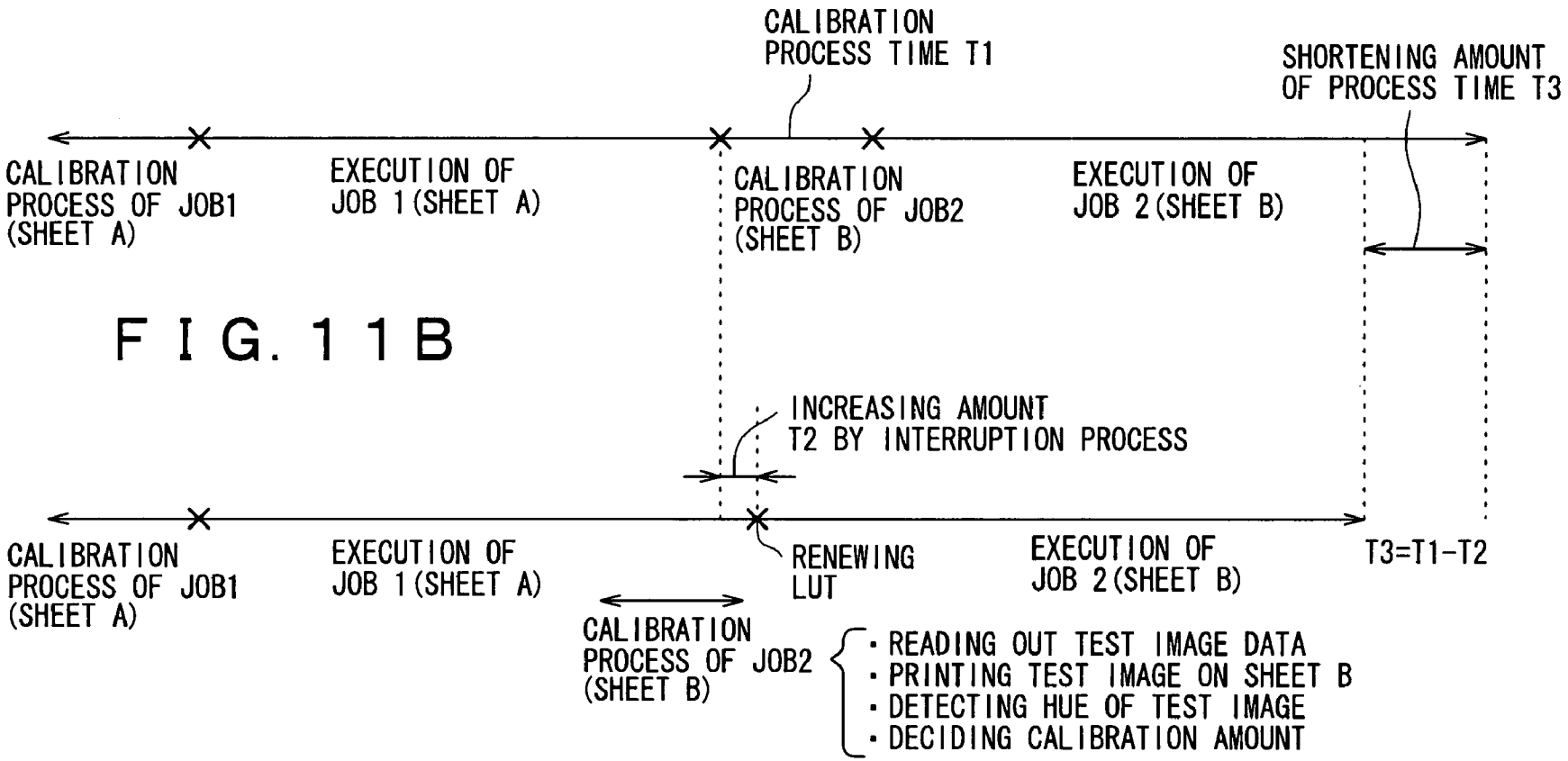
FIG. 11 is a view for explaining a color calibration process in which the color calibration control part 220 performs a scheduling in a modified example.

FIG. 11 is a view for explaining the color calibration process in the modified example wherein the color calibration controlling part 220 performs a scheduling. In this example, the "job 2 " becomes the subject for the color calibration process, so that the color calibration process should be completed by the time when the job 2 is started.

As shown in FIG. 11, when the "job 1" that is preceding the "job 2" that is the subject for the color calibration is executed, the color calibration controlling part 220 performs at least one of the reading of the test image by the job obtaining part 300, toner image formation by the write controlling part 350 and image forming unit 14, secondary transfer of the test image (toner image) by the intermediate transfer device 16, fixing process of the test image (toner image) by the fixing device 19, reading of the test image by the colorimetric sensor 189 and calculation of the calibration value based upon the test image by the calibration value deciding part 364, to thereby enhance the productivity of the printer device 10. It should be noted that the renewal of the look-up table by the calibration value deciding part 234 should be executed after the completion of the "job 1".

Specifically, the color calibration controlling part 260 causes the job generating part 220 to generate the job in which the printing process of the test image in the color calibration process is interrupted in the preceding "job 1". The job generating part 210 reconstructs the job according to this, whereby it generates the job in which the process for printing the test image with the recording sheet and screen that are used for the subsequent job is interrupted in the preceding job, and then, it inserts, after this job, the calibration job (i.e., the calibration job from which the printing process of the test image is omitted) for causing to perform the renewing process of the look-up table by the calibration value deciding part 234.

This enables the printer device 10 to perform a part of the process included in the color calibration process (for example, reading of the test image by the job obtaining part 300, reading of the test image by the colorimetric sensor 189 and the calculation of the calibration value by the calibration value deciding part 364 based upon the test image) simultaneous with the "job 1" and to renew the look-up table by the calibration value deciding part 234 immediately after the completion of the "job 1", thereby being capable of restraining the reduction in productivity due to the color calibration process. Specifically, the processing time of the "job 1" increases (referred to as increasing amount T2) by the interruption of at least one part of the color calibration process, but almost all (processing time T1) the color calibration process such as the calculation of the calibration value can be executed simultaneous with the "job 1", resulting in shortening of all processing time up to the completion of the "job 2" (shortening amount T3).

As explained above, the printer device 10 in this embodiment causes at least one part of the color calibration process to be interrupted in the preceding job to be simultaneously processed, thereby being capable of restraining the reduction in productivity due to the color calibration process.

Further, it is considered as a second modified example that the printer device 10 prints the image to be printed according to the instruction from the user and the test image onto a single recording sheet. For example, the printer device 10 may print the test image at the peripheral edge portion (the area that is cut) of the recording sheet on which an image is printed according to the instruction from the user.

For example, in the case where the type of the recording sheet is the same in the job now being executed and the subsequent job and only the screen is changed, the test image is printed at the peripheral edge portion of the recording sheet used in the job now being executed. Specifically, the job generating part 210 generates a job for printing a composite image wherein the test image is arranged around the image that should be printed according to the instruction from the user, based upon the image data that should be printed according to the instruction from the user and the data of the test image. When the job obtaining part 300 obtains this job, it composes the image data that should be printed according to the instruction from the user and the data of the test image read from the test image storing part 310 and outputs the resultant to the image correcting part 320. The image correcting part 320 applies the same image quality correction to the entire composite image and outputs the resultant to the screen processing part 340. The screen processing part 340 switches a screen between the area of the image that should be printed according to the request from the user and the area of the test image for the data of the composite image inputted from the image correcting part 320. Specifically, the screen processing part 340 applies a screen according to the image that should be printed according to the request from the user in the area of this image, while it applies a screen used in the subsequent job that is the subject of the color calibration process in the area of the test image.

As described above, the printer device 10 prints the image that should be printed according to the request from the user and the test image on a single recording sheet, thereby being capable of restraining the reduction in productivity due to the printing process of the test image.

Further, a job is separated by the changeover of the type of the recording sheet 42 or screen in the abovementioned embodiment, but a job may optionally be separated according to the instruction from the user as another modified example. Specifically, when the user designates the separation point of the job and gives a print command, the job generating part 210 divides the job at the designated separation point. Moreover, the job generating part 210 inserts the calibration job between the jobs divided according to the designation from the user. This allows the printer device 10 to set the timing of the color calibration process according to the intention of the user.

As described hereinabove, the control section controls the image forming section so as to form an image for color calibration on the recording medium at the timing when the continuity of the image to be formed or the recording medium is broken, and the calibration section performs a color calibration process based upon the image for the color calibration formed by the image forming section.

For example, the image forming device of the present invention can further include a screen section that applies a screen process to image data by use of a screen according to an image to be formed, wherein the image forming section forms an image based upon image data that is subject to the screen process by the screen section and the control section reflects the result of the color calibration by the calibration section and/or causes the image forming section to form the image for the color calibration at a timing according to a changeover of a recording sheet or the screen used for the image formation.

For example, the control section reflects the result of the color calibration by the calibration section and/or causes the image forming section to form the image for the color calibration at a timing according to a changeover of a number of colors used for the image formation.

For example, the control section reflects the result of the color calibration by the calibration section and/or causes the image forming section to form the image for the color calibration at a timing when an image of a single color is changed to an image of plural colors.

For example, the image forming section successively forms a number of set of images required by a user, and the control section reflects the result of the color calibration by the calibration section and/or causes the image forming section to form the image for the color calibration at a timing according to a timing of the changeover of the set.

For example, the image forming device of the present invention further includes a process dividing section that divides an image forming process required by the user into plural process units, wherein the image forming section successively executes each process unit divided by the process dividing section and the control section reflects the result of the color calibration by the calibration section and/or causes the image forming section to form the image for the color calibration at a timing when the process unit executed by the image forming section is changed over.

For example, the image forming device of the present invention further includes a factor monitoring section that monitors a variable factor that is a cause of fluctuation of a color development characteristic of the image formed on the recording medium, wherein the control section allows the color calibration process by the calibration section in a case where the variable factor monitored by the factor monitoring section exceeds a predetermined range and the continuity of the image to be formed or the recording sheet is broken while inhibiting the color calibration process by the calibration section in other cases.

For example, the control section inhibits the color calibration process by the calibration section on the condition that a remaining number of images that should be successively formed becomes less than a predetermined value.

An image forming device of the present invention includes an image forming section that forms an image on a recording medium, a control section that, when plural images are successively formed by the image forming section, controls the image forming section so as to form an image for color calibration on the recording medium at a timing when a continuity of the image to be formed or the recording medium is broken and a calibration section that performs a color calibration process based upon the image for the color calibration formed by the image forming section.

A calibration method of the present invention is the one of an image forming device that successively forms plural images, wherein a color calibration process is performed based upon an image formed on a recording medium when the plural images are successively formed and a result of the color calibration process is reflected on an image forming process at a timing when a continuity of the image to be formed or the recording medium is broken.

A calibration method of the present invention is the one of an image forming device that successively forms plural images, wherein, when the plural images are successively formed, an image for color calibration is formed on a recording medium at a timing when a continuity of the image to be formed or the recording medium is broken and a color calibration process is performed based upon the formed image for the color calibration. In an image forming device that successively forms plural images, a program of the present invention causes the image forming device to execute a step of performing a color calibration process based upon an image formed on a recording medium when the plural images are successively formed and a step of reflecting a result of the color calibration process on an image forming process at a timing when a continuity of the image to be formed or the recording medium is broken.

In an image forming device that successively forms plural images, a program of the present invention causes the image forming device to execute a step of forming an image for color calibration on a recording medium at a timing when a continuity of the image to be formed or the recording medium is broken in a case where the plural images are successively formed and a step of performing a color calibration process based upon the formed image for the color calibration.

According to the image forming device of the present invention, satisfactory color calibration can be performed.

The entire disclosure of Japanese Patent Application No. 2003-402813 filed on Dec. 2, 2003 including specification, claims, drawings and abstract is incorporated herein by reference in its entirety.

What is claimed is:

1. An image forming device comprising:

a image forming part that forms an image onto a recording medium;

a calibration part that performs a color calibration process based upon the image formed on the recording medium; and a controller that, when a plurality of images are successively formed by the image forming part, reflects a result of the color calibration process by the calibration part on an image forming process at a timing when a continuity of the formed image or the recording medium is broken, wherein the calibration is performed during one print job.

2. The image forming device according to claim 1, wherein the controller controls the image forming part so as to form an image for color calibration on the recording medium at the timing when the continuity of the image to be formed or the recording medium is broken, and the calibration part performs a color calibration process based upon the image for the color calibration formed by the image forming part.

3. The image forming device according to claim 2 further comprising:

a screen processor that applies a screen process to image data by use of a screen according to an image to be formed, wherein the image forming part forms an image based upon image data that is subject to the screen process by the screen processor and the controller reflects the result of the color calibration process by the calibration part and causes the image forming part to form the image for the color calibration at a timing according to a changeover of a recording sheet or the screen used for the image formation.

4. The image forming device according to claim 2, wherein the controller reflects the result of the color calibration process by the calibration part and causes the image forming part to form the image for the color calibration at a timing according to a changeover of a number of colors used for the image formation.

5. The image forming device according to claim 4, wherein the controller reflects the result of the color calibration process by the calibration part and causes the image forming part to form the image for the color calibration at a timing when an image of a single color is changed to an image of a plurality of colors.

6. The image forming device according to claim 2, wherein the image forming part successively form a number of set of images required by a user, and the controller reflects the result of the color calibration process by the calibration part and causes the image forming part to form the image for the color calibration at a timing according to a timing of a changeover of the set.

7. The image forming device according to claim 2 further comprising:

a process dividing part that divides an image forming process required by the user into a plurality of process units, wherein the image forming part successively executes each process unit divided by the process dividing part and the controller reflects the result of the color calibration process by the calibration part and causes the image forming part to form the image for the color calibration at a timing when the process unit executed by the image forming part is changed over.

8. The image forming device according to claim 1 further comprising:

a factor monitor that monitors a variable factor that is a cause of fluctuation of a color development characteristic of the image formed on the recording medium, wherein the controller allows the color calibration process by the calibration part in a case where the variable factor monitored by the factor monitor exceeds a predetermined range and the continuity of the image to be formed or the recording medium is broken while inhibiting the color calibration process by the calibration part in other cases.

9. The image forming device according to claim 1, wherein the controller inhibits the color calibration process by the calibration part on the condition that a remaining number of images that should be successively formed becomes less than a predetermined value.

10. An image forming device comprising:

a image forming part that forms an image on a recording medium;

a controller that, when a plurality of images are successively formed by the image forming part, controls the image forming part so as to form an image for color calibration on the recording medium at a timing when a continuity of the image to be formed or the recording medium is broken; and a calibration part that performs a color calibration process based upon the image for the color calibration formed by the image forming part during one print job.

11. A calibration method of an image forming device that successively forms a plurality of images comprising:

performing a color calibration process based upon an image formed on a recording medium when the plurality of images are successively formed during one print job: and reflecting a result of the color calibration process on an image forming process at a timing when a continuity of the image to be formed or the recording medium is broken.

12. A calibration method of an image forming device that successively forms a plurality of images comprising:

forming an image for color calibration on a recording medium at a timing when a continuity of the image to be formed or the recording medium is broken in a case where the plurality of images are successively formed; and performing a color calibration process based upon the formed image for the color calibration during one print job.

13. A storage medium readable by a computer, the storage medium storing a program of instructions executable by the computer in an image forming device that successively forms a plurality of images, the program to perform a function for causing the image forming device to execute the steps of:

performing a color calibration process based upon an image formed on a recording medium when the plurality of images are successively formed during one print job; and reflecting a result of the color calibration process on an image forming process at a timing when a continuity of the image to be formed or the recording medium is broken.

14. A storage medium readable by a computer, the storage medium storing a program of instructions executable by the computer in an image forming device that successively forms a plurality of images, the program to perform a function for causing the image forming device to execute the steps of:

forming an image for color calibration on a recording medium at a timing when a continuity of the image to be formed or the recording medium is broken in a case where the plurality of images are successively formed; and performing a color calibration process based upon the formed image for the color calibration during one print job.

* * * * *